US005771599A

United States Patent [19]

Uchimura et al.

[11] Patent Number: 5,771,599

[45] Date of Patent: Jun. 30, 1998

[54] METHOD OF AND INSTRUMENT FOR MEASURING ROLL DIAMETER IN ROLL GRINDER

[75] Inventors: Hiroshi Uchimura, Numazu; Takazumi Watanabe, Mishima; Masayuki Tatara, Numazu; Yoshinori Hata; Kazuo Kimura, both of Fujisawa, all of Japan

[73] Assignees: Toshiba Kikai Kabushiki Kaisha, Tokyo; Kanto Special Steel Works, Ltd., Fujisawa, both of Japan

[21] Appl. No.: 704,998

[22] Filed: Aug. 29, 1996

[30] Foreign Application Priority Data

May 31, 1996 [JP] Japan ..... 8-138609

[51] Int. Cl.[6] ..... G01B 5/08; G01B 7/12

[52] U.S. Cl. ..... 33/657; 33/702; 33/555.1; 33/545

[58] Field of Search ..... 33/657, 702, 712, 33/783, 784, 792, 793, 803, 805, 555.1, 501.45, 545

[56] References Cited

U.S. PATENT DOCUMENTS

| | | | |
|---|---|---|---|
| 3,332,153 | 7/1967 | Loewen | 33/702 |
| 4,811,524 | 3/1989 | Corallo | 33/783 |
| 4,934,105 | 6/1990 | Sigg | 451/5 |
| 4,958,442 | 9/1990 | Eckhardt | 33/555.1 |
| 5,042,161 | 8/1991 | Hodge | 33/501.45 |
| 5,052,121 | 10/1991 | Wachtler | 33/702 |

FOREIGN PATENT DOCUMENTS

| | | |
|---|---|---|
| 0309960 | 9/1988 | France . |
| 3012178 | 4/1980 | Germany . |
| 0035627 | 1/1981 | Germany . |
| 58-022659 | 2/1983 | Japan . |

*Primary Examiner*—Christopher W. Fulton
*Attorney, Agent, or Firm*—Finnegan, Henderson, Farabow, Garrett & Dunner, L.L.P.

[57] ABSTRACT

A method of measuring a roll diameter of a roll is provided. At first, a step-shaped conical master roll consisting of a plurality of diametrical parts is prepared and then, the diameters of the diametrical parts under predetermined standard temperature are measured. After mounting the master roll on a roll grinder under a temperature condition similar to that surrounding the roll mounted on the roll grinder, a diameter of one diametrical part, of which standard diameter is closest to the roll diameter of the roll, is measured. Next, a difference between the diameter value of the diametrical part and the standard diameter value is calculated as a correction value, so that the roll diameter value of the roll is corrected by the correction value.

8 Claims, 4 Drawing Sheets

METHOD OF AND INSTRUMENT FOR MEASURING ROLL DIAMETER IN ROLL GRINDER

BACKGROUND OF THE INVENTION

1. Field of the Invention

The present invention relates to a method of measuring a diameter of a roll in a roll grinder, which will be referred to "roll diameter" hereinafter, and an instrument for measuring the roll diameter in the roll grinder. More particularly, it relates to the measuring method and instrument for correcting variations of measurements of the roll diameter due to changes in temperature automatically.

2. Description of the Related Art

Hitherto, in the roll grinder, a measuring of the roll diameter has been carried out by interposing the roll above the roll grinder between a pair of movable gauge heads as roll diameter measuring means, which are mounted on a carriage so as to reciprocate in the axial direction of the roll. The roll grinder further includes a master bar attached thereto, of which dimension has been previously known. Prior to measuring the roll diameter, the dimension of the master bar is firstly measured by using the above roll diameter measuring means. Thereafter, the measurements by the roll diameter measuring means are calibrated by the above roll diameter detected by the roll diameter measuring means.

In the conventional calibration for the roll diameter measuring means, although the measurement error due to temperature changes of the roll diameter measuring means itself can be corrected, it is impossible to correct variations of the roll diameter measurements due to temperature changes of the roll. In other words, it is impossible to measure the absolute dimension of the roll diameter, i.e. a roll diameter under standard temperature. Hereto, even if a difference between a dimension of the master bar under the standard temperature, i.e. the standard dimension, and a measurement of the master bar measured by the roll diameter measuring means under temperature at measuring the roll diameter is calculated as a correction (value) for determining the absolute dimension of the roll diameter, there still remains a problem because of the only correction value which is brought by the single measurement of the master bar. In such a case, the measurements of the roll diameter would be corrected by the above correction value derived from the only basic dimension of the master bar, irrespective of largeness of roll diameter. Therefore, when the roll diameter as the measuring object is close to the basic dimension of the master bar, it is possible to correct the measurement with high accuracy. To the contrary, when the roll diameter is far from the basic dimension, the correcting accuracy for the measurement of the roll diameter is influenced since such a roll diameter causes an increase of the content of movement error of the movable gauge heads of the roll diameter measuring means in the diametrical direction of the roll.

Another problem resides in that the heat capacity of the master bar is remarkably small in comparison with the heat capacity of the roll. Although the master bar is disposed under the similar temperature condition as that of the roll on the roll grinder, there would be produced a difference in dimensional changes between the master bar and the roll due to the difference in heat capacity therebetween, so that it is impossible to obtain an appropriate correction value, thereby limiting the accuracy in correcting the measurement of the roll diameter.

SUMMARY OF THE INVENTION

It is therefore an object of the present invention to provide a measuring method for measuring a roll diameter in a roll grinder and a measuring instrument for measuring the roll diameter, both of which are capable of correcting the measurement of the roll diameter with high accuracy and without containing the movement error of movable gauge heads of the roll diameter measuring means in the diametrical direction of the roll to the large extent, irrespective of the largeness of the roll diameter and which can prevent the correction accuracy of the roll diameter measurements, which is dependent of the difference in heat capacity between the master bar and the roll, from reducing.

The object of the present invention described above can be accomplished by a method of measuring a roll diameter of a roll mounted on a roll grinder having roll diameter measuring means for measuring the roll diameter, the method comprising steps of:

preparing a step-shaped conical master roll consisting of a plurality of diametrical parts arranged coaxially, respective diameters of the diametrical parts being different from each other;

measuring the diameters of the diametrical parts under a condition at a predetermined temperature thereby obtaining standard diameters values of the diametrical parts;

mounting the master roll on the roll grinder thereby placing the master roll under a temperature condition similar to that surrounding the roll mounted on the roll grinder;

measuring a diameter of one of the diametrical parts by the roll diameter measuring means, the standard diameter value of the one diametrical part being closest to the roll diameter value of the roll;

calculating a difference between the diameter value of the one diametrical part and the standard diameter value as a correction value; and correcting the roll diameter value of the roll, which is measured by the roll diameter measuring means, by the correction value.

With this method of measuring the roll diameter, the roll diameter measurement is corrected by the correction value brought by the diametrical part of the master roll closes to the roll diameter. Since the master roll is shaped to have the plurality of diametrical parts different from each other thereby providing a stepped conical configuration, the heat capacity of the master roll is remarkably large in comparison with that of the above-mentioned master bar, being closer to the heat capacity of the roll to be measured. Consequently, it is possible to decrease a reduction in correcting accuracy against the measured roll diameter, which is depending on the difference in heat capacity between the master roll and the roll.

In the present method mentioned above, preferable, the measuring step of the one diametrical part of the master roll and the calculating step of the correction value are executed every measuring of the roll diameter of the roll.

Further, it is also preferable that the measuring step of the one diametrical part of the master roll and the calculating step of the correction value are executed when an environmental temperature about the roll grinder changes over a predetermined value.

Alternatively, it is preferable that the measuring step of the one diametrical part of the master roll and the calculating step of the correction value are executed when time has passed over a predetermined value.

The above object of the present invention described above can be also accomplished by an apparatus for measuring a roll diameter of a roll mounted on a roll grinder having a carriage so as to reciprocate in the axial direction of the roll, a grinding wheel head mounted on the carriage and a work mounting bed for mounting the roll thereon, the apparatus comprising:

roll diameter measuring means for measuring the roll diameter of the roll, the roll diameter measuring means being mounted on the carriage and having movable gauge heads;

a step-shaped conical master roll arranged in alignment with a center axis of the roll mounted on the work mounting bed, the master roll having a plurality of diametrical parts of which diameters are different from each other;

standard diameter value storing means for storing standard diameters values of the diametrical parts, the standard diameters values being obtained by measuring respective diameters of the diametrical parts of the master roll under a condition of a predetermined temperature; and roll diameter measurement correcting means for calculating a difference between a diameter value of one of the diametrical parts, of which standard diameter value is closest to the roll diameter value of the roll, measured by the roll diameter measuring means and the standard diameter value stored in the standard diameter storing means as a correction value, and correcting the roll diameter value of the roll, which is measured by the roll diameter measuring means, by the correction value.

In the present invention, the diameters of the respective diametrical parts of the master roll are measured by the roll diameter measuring means. Further, by the roll diameter measurement correcting means, the difference between the diameter of the diametrical parts of which standard diameter is closest to the roll diameter of the roll and the standard diameter stored in the standard diameter storing means is calculated as the correction value, so that the roll diameter of the roll is corrected by the correction value.

These and other objects and features of the present invention will become more fully apparent from the following description and appended claims taken in conjunction with the accompany drawing.

DESCRIPTION OF THE PREFERRED EMBODIMENT

An embodiment of the present invention will be described with reference to the drawings.

Figure 1:
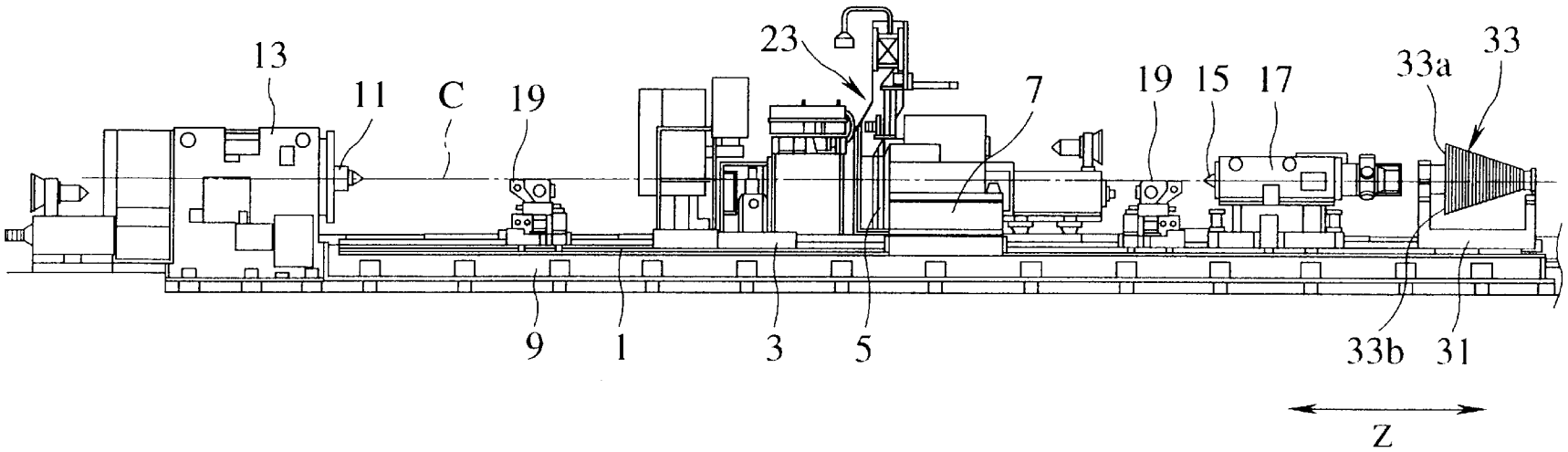
FIG. 1 is a front view of a roll grinder having a roll diameter measuring instrument in accordance with an embodiment of the present invention.
Figure 2:
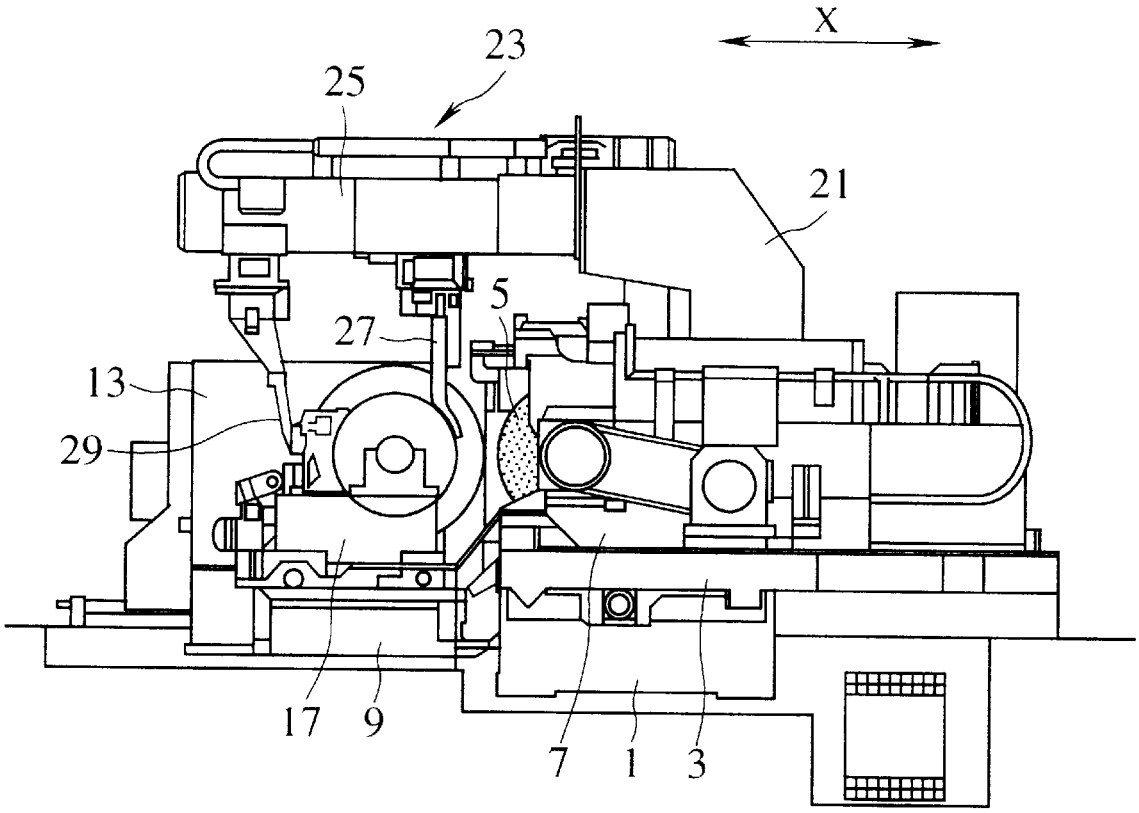
FIG. 2 is a side view of the roll grinder of FIG. 1.

FIGS. 1 and 2 show a roll grinder having a roll diameter measuring instrument in accordance with the invention. The roll grinder includes a carriage 3 reciprocating on a carriage mounting bed 1 in the direction of Z-axis identical to an axial direction of the roll, i.e. left and right directions in FIG. 1, a grinding wheel head 7 which is mounted on the carriage 3 so as to reciprocate in the direction of X-axis identical to left and right directions In FIG. 2 and which supports a grinding wheel 5 rotatably, a headstock 13 arranged on a work mounting bed 9 on the left side of FIG. 1 to have a main spindle 11, a footstock 17 arranged on the work mounting bed 9 so as to be displaceable in the direction of Z-axis and provided with a work center 15, and neckrests 19 arranged on the work mounting bed 9 between the headstock 13 and the footstock 17. In FIG. 1, alphabet C denotes a center axis of the not-shown roll as an object to be ground, which is arranged between the headstock 13 and the work center 15.

A roll diameter measuring instrument 23 is attached to the carriage 3 through an arm 21. Provided with a pair of gauge heads 27, 29 which are arranged so as to move on a cross rail 25 in the direction of X-axis (the diametrical direction of the roll), the roll diameter measuring instrument 23 operates to measure a diameter of the roll by a coordinate difference between the gauge head 27 and the gauge head 29 in the direction of X-axis. Note, the cross rail 25 extends in the direction of X-axis on the work mounting bed 9 horizontally.

Arranged on the back side of the footstock 17 is a master roll 33 which is fixed on the right end of the work mounting bed 9 of FIG. 1 through a bracket 31 in the form of yoke. The master roll 33, which includes a plurality of diametrical parts 33*a*, 33*b*, . . . coaxially arranged to form a stepped conical configuration, is arranged in alignment with the center axis C of the roll above the work mounting bed 9. Both ranges of maximum and minimum diameters of the diametrical parts 33*a*, 33*b*, . . . are determined corresponding to the measurable extent of the roll diameter measuring instrument 23 and each diametrical pitch among the parts 33*a*, 33*b*, . . . is established in accordance with the required accuracy. When the measurable extent of the roll diameter is from 100 mm to 1000 mm, it would be preferable of 50 to 100 mm in diametrical pitch.

Upon moving the carriage 3 up to the position of the master roll 33 in the direction of Z-axis, the diameter measuring of the diametrical parts 33*a*, 33*b*, . . . of the master roll 33 is carried out by the roll diameter measuring instrument 23.

Figure 3:
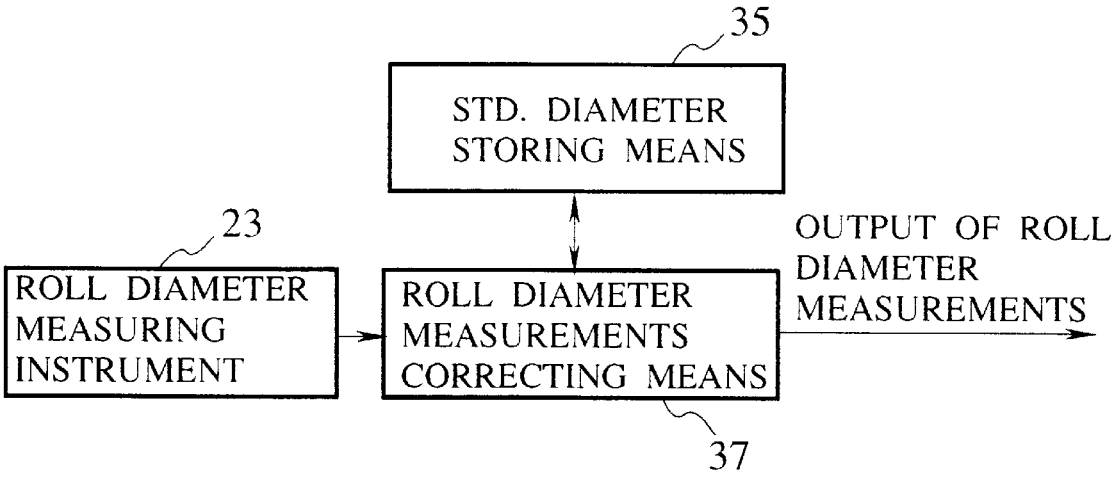
FIG. 3 is a block diagram showing a constitution of the roll diameter measuring instrument of the present invention.

FIG. 3 shows a structure of the roll diameter measuring apparatus of the invention. The apparatus includes standard diameter storing means 35 for storing "standard" diameters of the respective diametrical parts 33*a*, 33*b*, . . . measured under the standard temperature condition and roll diameter measurement correcting means 37 for calculating a difference between the diameter measurement of the master roll, which can be obtained by the roll diameter measuring instrument 23 measuring a diameter of the diametrical part having the standard diameter closest to the roll diameter, and the standard diameter stored in the storing means 35, as a correction value. The roll diameter measurement correcting means 37 further corrects the roll diameter measurement, which has been measured by the instrument 23, by the above correction value.

According to the roll diameter measuring method of the present invention, the diameters of the respective diametrical parts 33*a*, 33*b*, . . . of the master roll 33 are measured under a condition at a predetermined "standard" temperature, so that the standard diameters of the parts 33*a*, 33*b*, . . . can be obtained and then stored in the standard diameter storing means 35.

In the measurement of the roll diameter of the roll mounted on the roll grinder, a diameter of one diametrical part, of which standard diameter is closest to the roll diameter, is measured by means of the roll diameter measuring instrument 23. Then, a difference between the so-measured "master roll" diameter of the above diametrical part and the above standard diameter is calculated as a correction value and thereafter, the roll diameter measured by the roll diameter measuring instrument 23 is corrected by the correction value. Consequently, it is possible to obtain the precise absolute dimension of the roll diameter irrespective of largeness of the roll diameter.

The measuring of the diametrical part of the master roll 33 and the calculation of the correction value have only to be carried out every measuring of the roll diameter or executed when the temperature varies over a predetermined value (e.g. b: constant) or when time has passed over another predetermined value (e.g. a: constant).

Figure 4:
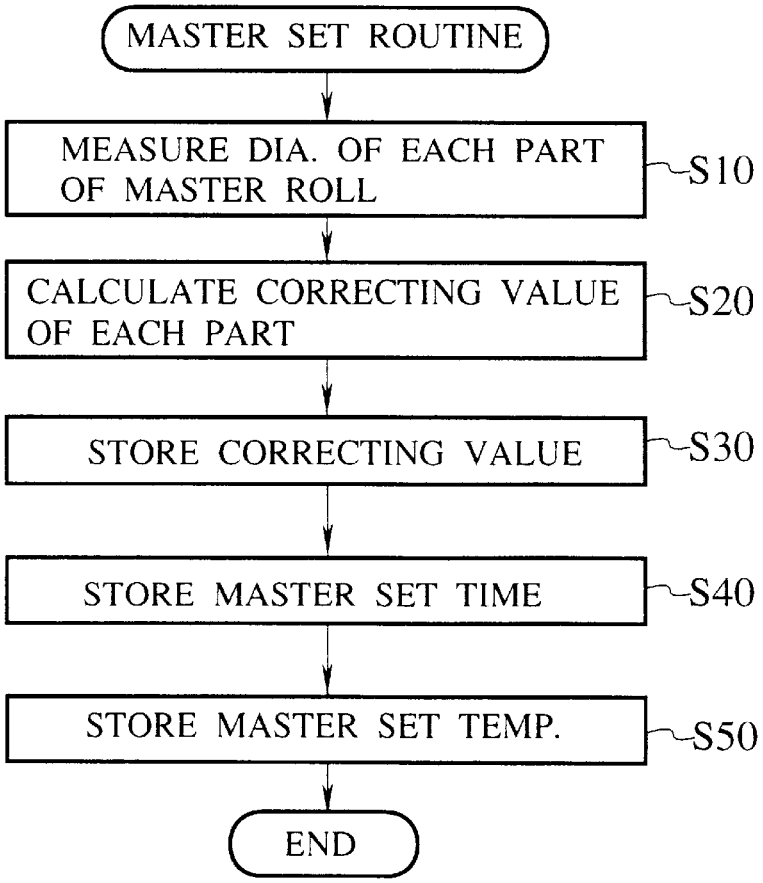
FIG. 4 is a flow chart showing a master set routine in accordance with a roll diameter measuring method of the present invention.
Figure 5:
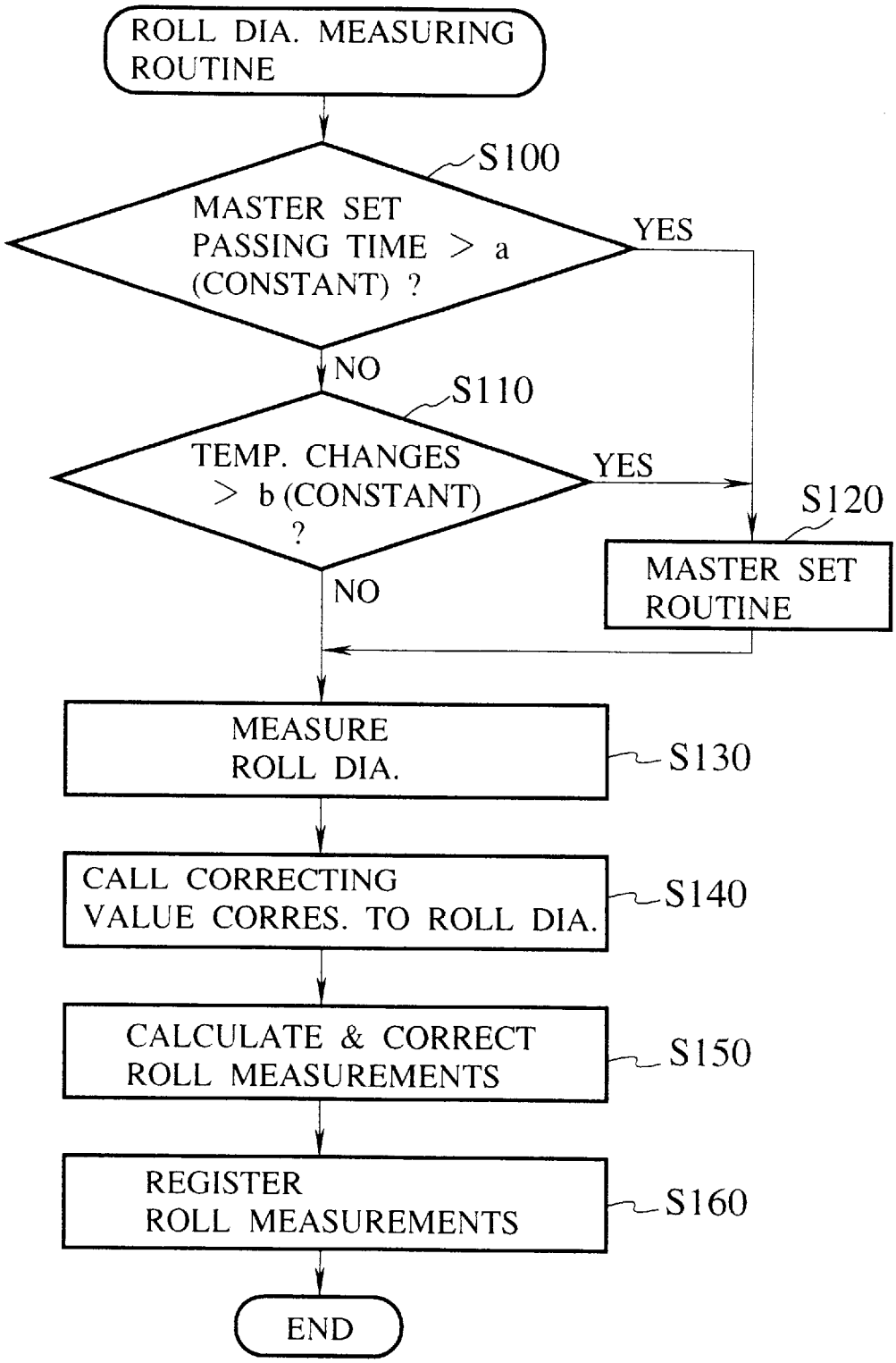
FIG. 5 is a flow chart showing a roll diameter measuring routine in the roll diameter measuring method of the present invention.

We now describe how to embody the method of measuring the roll diameter in accordance with the present invention, with reference to FIGS. 4 and 5. FIG. 4 is a flow chart of master set routine by which the correction value is set against each of the diametrical parts 33*a*, 33*b*, . . . of the master roll 33.

In accordance with the master set routine, after the carriage 3 is driven up to the position of the master roll 33 in the direction of Z-axis, the respective diametrical parts 33*a*, 33*b*, . . . are measured by the roll diameter measuring instrument 23. Then, the resulting measurements, i.e. diameters of the diametrical parts are stored in a work memory etc. that the roll diameter measurement correcting means 37 possesses (step S10).

Next, at step S20, it is executed to calculate the respective correction values for the respective diametrical parts 33*a*, 33*b*, . . . by subtracting the respective diameter measurements of the master roll from the standard diameters which have been previously stored for the respective diametrical parts 33*a*, 33*b*, . . . in the standard diameter storing means 35 and the routine goes to step 30 where the correction values are stored in the work memory.

Then, at step S 40, it is executed to set the present time as the master set time and store it in the work memory. At sequent step S 50, it is executed to set the present temperature as the master set temperature and store it in the work memory.

FIG. 5 shows a routine for measuring the roll diameter. In this routine, at step S100, it is judged whether time lag between the master set time and the present time, i.e. time passage since master set, is more than the predetermined value a (constant), while it is judged whether a difference between the master set temperature and the present temperature is more than the predetermined value b (constant) at step S 110.

In either case that the master set passing time is more than the predetermined value a or case that temperature change is more than the predetermined value b, the routine goes to step S120 where the above mentioned master set routine is redone.

When the above time passage is not more than the predetermined value a and when the temperature change is not more than the predetermined value b, the routine goes to step S130 where the roll diameter of the now-shown roll on the work mounting bed 9 is measured by the roll diameter measuring instrument 23 since the master set at this time is believed to be effective.

Next, at step S140, the correction value corresponding to the roll diameter, i.e. the correction value brought by the diametrical part of the master roll 33 closest to the roll diameter, is called from the memory. Then, at sequent step S150, the roll diameter measurement is corrected by a calculation of adding the correction value into the roll diameter measurement and thereafter, the routine goes to step S160 where the measurement is registered.

Finally, it will be understood by those skilled in the art that the foregoing description is one of preferred embodiments of the present invention, and that various changes and modifications may be made to the present invention without departing from the spirit and scope thereof.

What is claimed is:

1. A method of measuring a roll diameter of a roll mounted on a roll grinder having roll diameter measuring means for measuring the roll diameter, said method comprising steps of:

preparing a step-shaped conical master roll consisting of a plurality of diametrical parts arranged coaxially, respective diameters of said diametrical parts being different from each other;

measuring the diameters of said diametrical parts under a condition at a predetermined temperature thereby obtaining standard diameters values of said diametrical parts;

mounting said master roll on said roll grinder thereby placing said master roll under a temperature condition similar to that surrounding said roll mounted on said roll grinder;

measuring a diameter of one of said diametrical parts by said roll diameter measuring means, the standard diameter value of said one diametrical part being closest to said roll diameter value of said roll;

calculating a difference between said diameter value of said one diametrical part and said standard diameter value as a correction value; and correcting said roll diameter value of said roll, which is measured by said roll diameter measuring means, by said correction value.

2. A method as claimed in claim 1, wherein said measuring step of said one diametrical part of said master roll and said calculating step of said correction value are executed every measuring of said roll diameter of said roll.

3. A method as claimed in claim 1, wherein said measuring step of said one diametrical part of said master roll and said calculating step of said correction value are executed when an environmental temperature about said roll grinder changes over a predetermined value.

4. A method as claimed in claim 1, wherein said measuring step of said one diametrical part of said master roll and said calculating step of said correction value are executed when time has passed over a predetermined value.

5. An apparatus for measuring a roll diameter of a roll mounted on a roll grinder having a carriage so as to reciprocate in the axial direction of said roll, a grinding wheel head mounted on said carriage and a work mounting bed for mounting said roll thereon, said apparatus comprising:

roll diameter measuring means for measuring said roll diameter of said roll, said roll diameter measuring means being mounted on said carriage and having movable gauge heads;

a step-shaped conical master roll arranged in alignment with a center axis of said roll mounted on said work mounting bed, said master roll having a plurality of diametrical parts of which diameters are different from each other;

standard diameter value storing means for storing standard diameter value of said diametrical parts, said standard diameter value being obtained by measuring respective diameters of said diametrical parts of said master roll under a condition of a predetermined temperature; and roll diameter measurement correcting means for calculating a difference between a diameter value of one of said diametrical parts, of which standard diameter value is closest to said roll diameter value of said roll, measured by said roll diameter measuring means and said standard diameter value stored in said standard diameter storing means as a correction value, and correcting said roll diameter value of said roll, which is measured by said roll diameter measuring means, by said correction value.

6. An apparatus as claimed in claim 5, wherein said roll diameter measuring means operates to measure said one diametrical part of said master roll every measuring of said roll diameter of said roll and said roll diameter measurement correcting means operates to calculate said correction value every measuring of said roll diameter of said roll, too.

7. An apparatus as claimed in claim 5, wherein said roll diameter measuring means operates to measure said one diametrical part of said master roll and said roll diameter measurement correcting means operates to calculate said correction value, when an environmental temperature about said roll grinder changes over a predetermined value.

8. A apparatus as claimed in claim 5, wherein said roll diameter measuring means operates to measure said one diametrical part of said master roll and said roll diameter measurement correcting means operates to calculate said correction value, when time has passed over a predetermined value.

* * * * *